US007033142B2

(12) United States Patent
Conrad et al.

(10) Patent No.: US 7,033,142 B2
(45) Date of Patent: Apr. 25, 2006

(54) VACUUM PUMP SYSTEM FOR LIGHT GASES

(75) Inventors: Armin Conrad, Herborn (DE); Peter Fahrenbach, Braunfels (DE); Matthias Mädler, Driedorf (DE)

(73) Assignee: Pfeifer Vacuum GmbH, Asslar (DE)

( * ) Notice: Subject to any disclaimer, the term of this patent is extended or adjusted under 35 U.S.C. 154(b) by 184 days.

(21) Appl. No.: 10/350,935

(22) Filed: Jan. 24, 2003

(65) Prior Publication Data

US 2004/0146410 A1 Jul. 29, 2004

(30) Foreign Application Priority Data

Jan. 24, 2003 (DE) ..... 103 02 764

(51) Int. Cl.
*F04B 23/08* (2006.01)

(52) U.S. Cl. ..... 417/201; 417/205; 417/423.4

(58) Field of Classification Search ..... 417/205, 417/423.4, 423.5, 199.1, 206, 201, 426, 246, 417/247, 245

See application file for complete search history.

(56) References Cited

U.S. PATENT DOCUMENTS

| | | | | |
|---|---|---|---|---|
| 3,536,418 | A * | 10/1970 | Breaux | 417/49 |
| 4,235,572 | A * | 11/1980 | Winkler et al. | 418/6 |
| 4,850,806 | A * | 7/1989 | Morgan et al. | 417/53 |
| 4,887,941 | A * | 12/1989 | Crinquette et al. | 417/2 |
| 4,919,599 | A * | 4/1990 | Reich et al. | 417/423.4 |
| 5,733,104 | A * | 3/1998 | Conrad et al. | 417/44.1 |
| 6,030,181 | A * | 2/2000 | Conrad | 417/53 |
| 6,435,811 | B1 * | 8/2002 | Beyer et al. | 415/90 |

* cited by examiner

*Primary Examiner*—Charles G. Freay
(74) *Attorney, Agent, or Firm*—Abelman, Frayne & Schwab

(57) ABSTRACT

A vacuum pump system includes at least one high-vacuum pump, a fore-vacuum pump, and at least one intermediate pump, arranged between the at least one high-vacuum pump and the fore-vacuum pump and having its inlet connected directly and exclusively with the outlet of the high-vacuum pump.

4 Claims, 3 Drawing Sheets

VACUUM PUMP SYSTEM FOR LIGHT GASES

BACKGROUND OF THE INVENTION

1. Field of the Invention

The present invention relates to a vacuum pump system for delivering light gases and including at least one high-vacuum pump.

2. Description of the Prior Art

A pump system for evacuating a receiver includes, e.g. a turbomolecular pump provided on the high-vacuum side and one or more fore-vacuum pumps for further delivering and for compressing to an atmospheric pressure gas that was condensed by the turbomolecular pump. These fore-vacuum pumps can be formed, e.g., as a combination of a rotary piston pump and a vane-type rotary pump, or as a dry compression pump discharged against atmospheric pressure. (DE-OS 38 28 608). Such pump systems are suitable for delivering and for compressing of gases with medium or high molecular weight (e.g., $N_2$, $O_2$, Ar). For pumping light gases (e.g., $H_2$, He), these systems are less suitable, in particular, when it is necessary to deliver a large quantity of gases. In this case, often several high-vacuum pumps are provided on the high-vacuum side for suction of the produced gases.

Conventional fore-vacuum pump systems are not in position to handle a large quantity of gases that accumulates at the gas outlet of a high vacuum pump. Up to the present, the conventional fore-vacuum pumps proved to be hardly suitable for handling light gases. The rotary piston pumps have only a small compression rate, the vane-type rotary pumps are not oil-free. They should be provided with a cooling system in which oil condences. This requires increased operational expenses and complicates the structure of the pumping system.

To improve transportation of light gases, often, a carrier gas is used. However, this solution is likewise associated with increased expenses. In addition, in this case, measures need to be taken to subsequently separate the gases. Moreover, the carrier gas adversely affects the fore-vacuum pressure and, thus, the pump characteristics of the entire system.

In many cases, the fore-vacuum system is spaced by a large distance from high-vacuum pump outlet, which results in increased conductance losses.

An object of the present invention is to provided a pump system suitable for pumping a large quantity of gases of which the light gases are the main component. The conventional system should be converted in a pump system suitable for achieving the object of the invention, using simple means.

SUMMARY OF THE INVENTION

The object of the invention is achieved with a vacuum pump system in which an intermediate pump is provided between the high-vacuum pump and the fore-vacuum pump and having a single inlet directly connected with the outlet of the high-vacuum pump.

The solution consists in increasing of the compression and suction capacity in the fore-vacuum region. This is achieved by providing an additional pump, further an intermediate pump, between the gas outlet of the high-vacuum pump and the suction inlet of the fore-vacuum system. It is important that the intermediate pump be directly connected, without large conductance losses, to the outlet of the high-vacuum pump.

According to the present invention, there can be provided one or more intermediate pumps. In case several intermediate pumps are provided, they can be connected in parallel or in series.

As an intermediate pump, a molecular pump can preferably be used, to which a regenerative pump, which operates in the same pressure range, belongs. Preferably, as a molecular pump, a turbomolecular pump is used.

Advantageously, the suction capacity of an intermediate pump should amount at least to 50% of the suction capacity of the high-vacuum pump.

The compression rate of light gases of such a pump is sufficiently high to insure compression of the quantity of the gas produced at the high-vacuum pump outlet and which can be delivered further without a loss. A further improvement in conductance and, thereby, an increase in the gas flow rate is insured by connecting the intermediate pump directly to the outlet of the high-vacuum pump.

The present invention provides a pump system which is suitable for delivery of a large quantity of gases the main component of which is a light gas and for compression of this quantity of gases to an atmospheric pressure. The system insures a super-proportional increase of the suction capacity at the high-vacuum side.

A particular advantage of a vacuum pump system according to the present invention consists in that the inventive system is compatible with conventional systems, i.e., they can be easily converted into a vacuum pump system for delivery of a large amount of a light gas, without significant additional expenses. At that, the suction system and the entire fore-vacuum system can be used without any changes. The addition of a molecular pump, as an intermediate pump, requires little space, which permits to produce a compact system which can be used, with a light modification, in a wide pressure region for all gases.

BRIEF DESCRIPTION OF THE DRAWINGS

Embodiments of the invention is shown in the drawings which show.

BRIEF DESCRIPTION OF THE PREFERRED EMBODIMENTS

Figure 1:
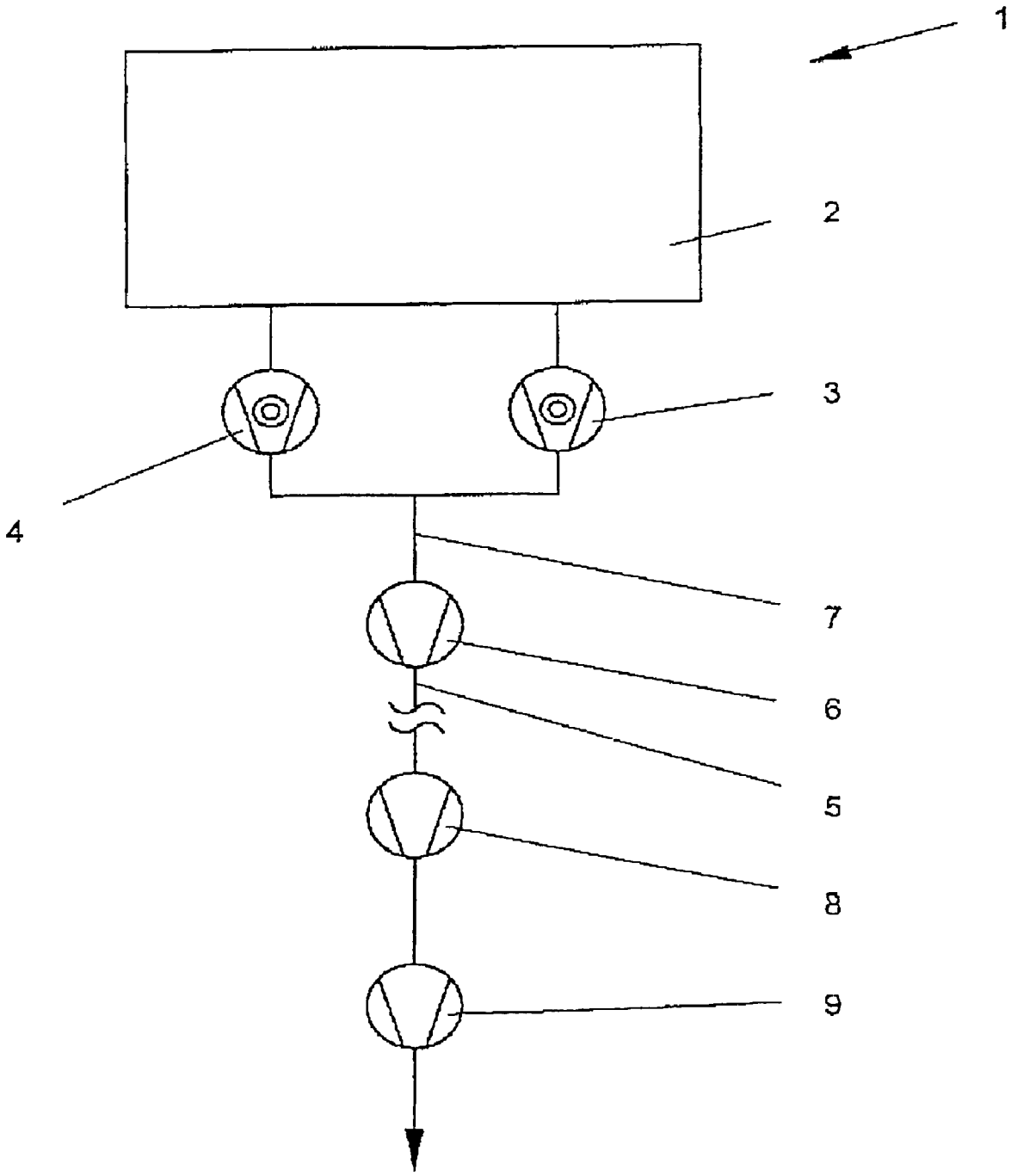
FIG. 1 vacuum pump system according to the present invention with a single intermediate pump.

FIG. 1 shows a vacuum pump system (1). Two high-vacuum pumps, preferably turbomolecular pumps, are associated with the receiver (2). A fore-vacuum system consists of two fore-vacuum pumps (8, 9) for compressing the pumped gas to atmospheric pressure. According to the invention, an intermediate pump (6) is located between the high-vacuum pump (3, 4) and fore-vacuum pumps (8, 9) and is directly connected with a common outlet (7) of the high-vacuum pumps (3, 4). The intermediate pump (6) serves for delivering the gas pumped by the high-vacuum pumps (3, 4) to the fore-vacuum pumps (8, 9) without loss.

The fore-vacuum system is provided at the outlet side (5) of the intermediate pump 6.

An extended stretch path can lie between the intermediate pump (6) and the fore-vacuum pumps (8, 9).

Figure 2:
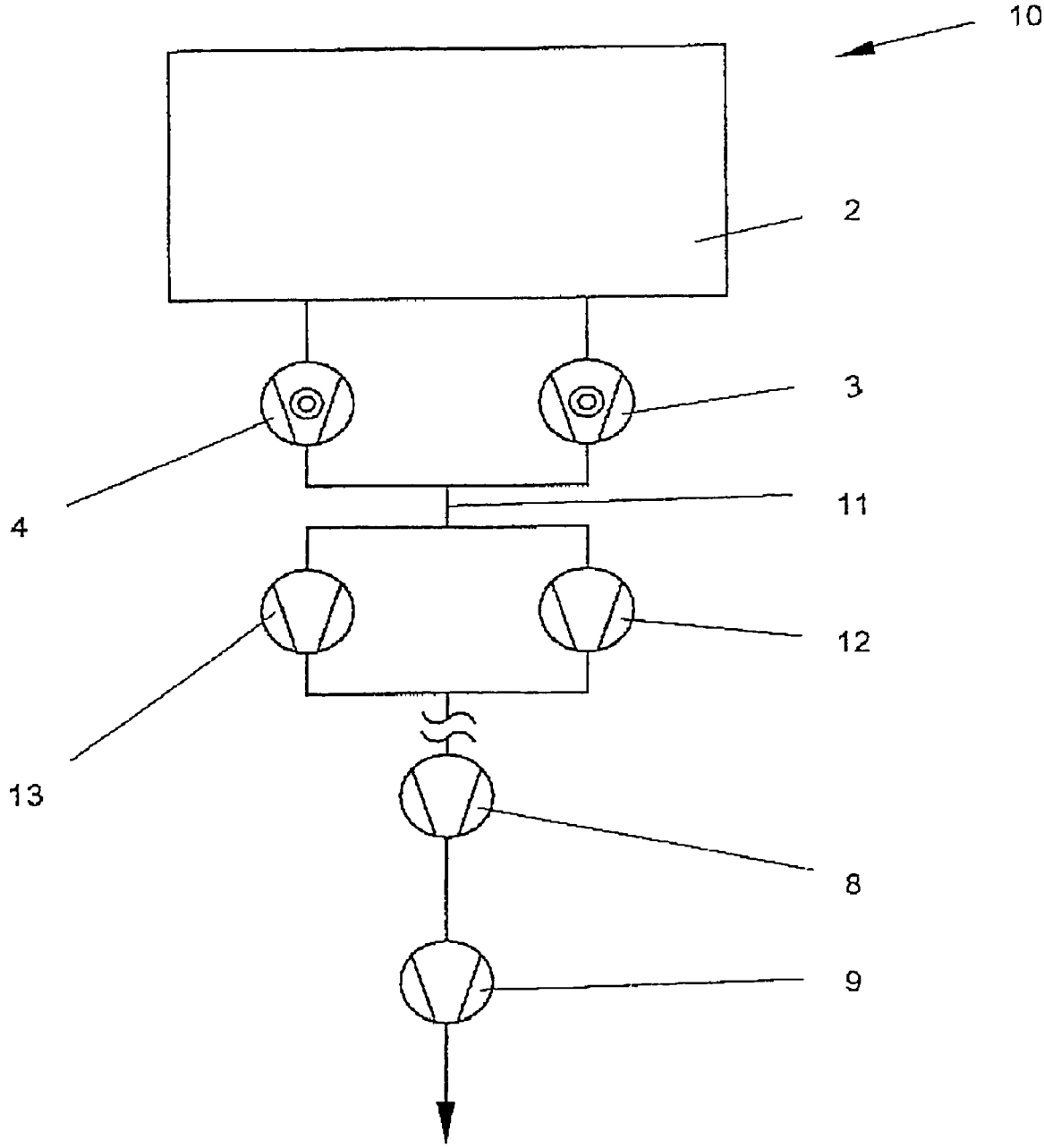
FIG. 2 a vacuum pump system with two intermediate pumps connected in parallel with each other.

FIG. 2 shows a vacuum pump system (10). Again two high-vacuum pumps (3, 4) are associated with the receiver (2). Two intermediate pumps (12, 13) are provided downstream of a common outlet 11. The intermediate pumps (12, 13) are connected in parallel in order to increase the suction capacity. As in FIG. 1, the fore-vacuum pumps (8, 9) are located downstream of the intermediate pumps (12, 13).

Figure 3:
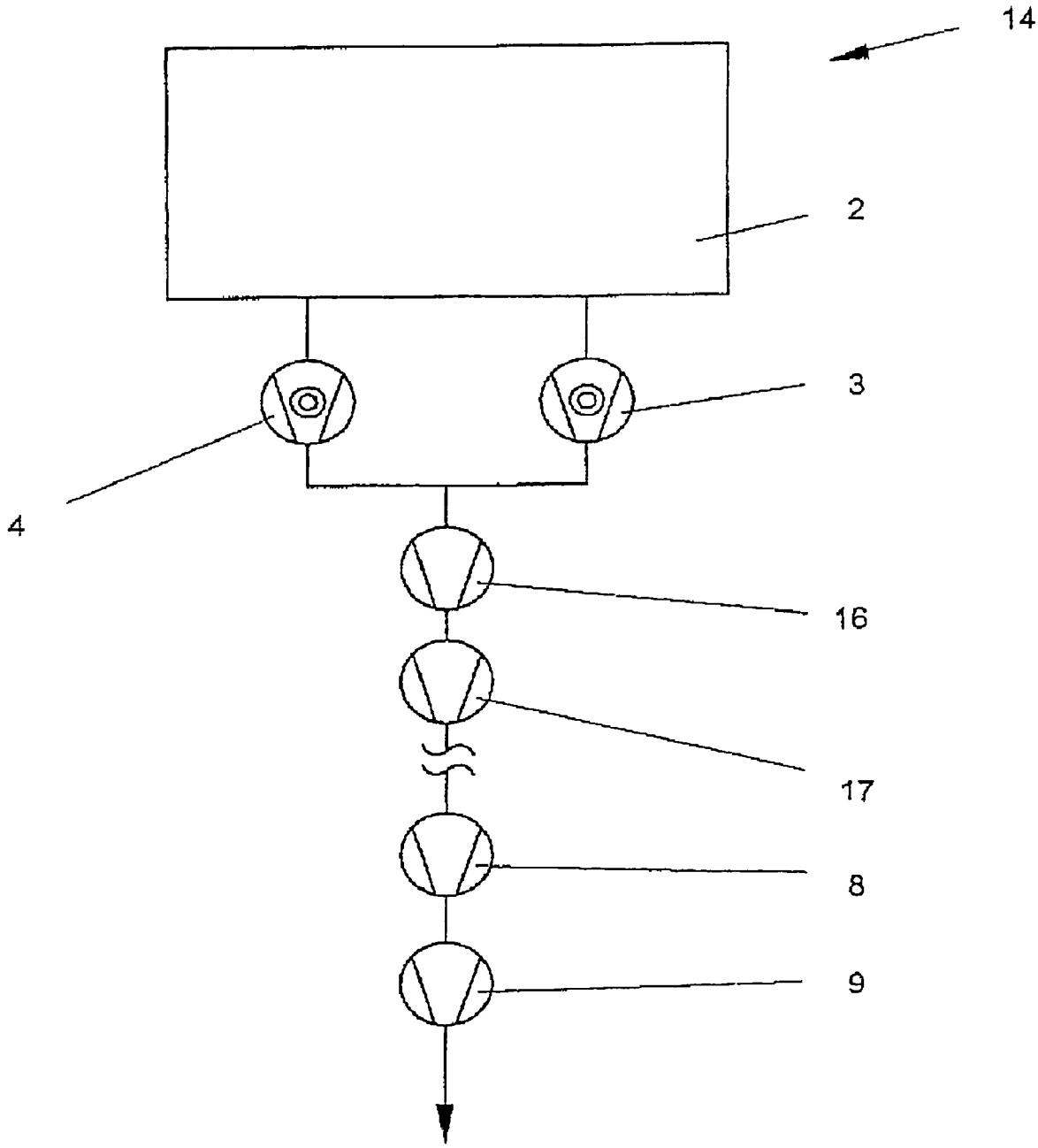
FIG. 3 a vacuum pump system with two intermediate pumps connected in series with each other.

FIG. 3 shows a vacuum pump system (14). Two turbomolecular pumps (3, 4) are associated with the receiver (2), Two intermediate pumps (16, 17) are arranged, without any noticeable conductance losses downstream of the turbomolecular pumps (3, 4). In order to increase compression, the intermediate pumps (16, 17) are connected in series with each other. As shown in FIGS. 1–2, a fore-vacuum system (8, 9) is arranged downstream of the intermediate pumps (16, 17).

REFERENCE NUMERALS

1 Vacuum pump system
2 Receiver
3,4 High-vacuum pumps
5 Outlet
6 Intermediate pump
7 Gas outlet
8,9 Fore-vacuum system
10 Vacuum pump system
11 Outlet
12,13 Intermediate Pumps
14 Vacuum pump system
16,17 Intermediate pump

The invention claimed is:

1. A vacuum pump system for delivering gas mixtures with large portions of light gases from a receiver, the vacuum pump system comprising at least one first high-vacuum pump having an inlet thereof connected with the receiver; at least one fore-vacuum pump for compressing the gas mixture to atmospheric pressure; at least one second high-vacuum pump arranged downstream of the first high-vacuum pump and upstream of the fore-vacuum pump and having an inlet thereof connected directly with an outlet of the first high-vacuum pump and an outlet thereof communicating with an inlet of the at least one fore-vacuum pump, and having a suction capacity of at least 50% of the suction capacity of the at least one first vacuum pump.

2. A vacuum pump system according to claim 1, comprising several second high-vacuum pumps arranged between the at least one first high-vacuum pump and connected one of parallel to each other and in series with each other.

3. A vacuum pump system according to claim 1, wherein the at least one second high-vacuum pump is formed as a molecular pump.

4. A vacuum pump system according to claim 3, wherein the molecular pump is a turbomolecular pump.

* * * * *